US009724593B2

(12) United States Patent
Sandusky

(10) Patent No.: US 9,724,593 B2
(45) Date of Patent: Aug. 8, 2017

(54) PUSHER TIP AND ASSOCIATED SYSTEMS

(71) Applicant: Hamboards Holdings, LLC, Ocean View, DE (US)

(72) Inventor: Donald A. Sandusky, Landenberg, PA (US)

(73) Assignee: HAMBOARDS HOLDINGS, LLC, Ocean View, DE (US)

( * ) Notice: Subject to any disclaimer, the term of this patent is extended or adjusted under 35 U.S.C. 154(b) by 0 days.

(21) Appl. No.: 15/197,011

(22) Filed: Jun. 29, 2016

(65) Prior Publication Data

US 2017/0001098 A1 Jan. 5, 2017

Related U.S. Application Data

(60) Provisional application No. 62/186,664, filed on Jun. 30, 2015.

(51) Int. Cl.

| | |
|---|---|
| ***A45B 3/00*** | (2006.01) |
| ***A63C 17/00*** | (2006.01) |
| ***A63C 17/26*** | (2006.01) |
| ***B63H 16/04*** | (2006.01) |
| *A63C 17/01* | (2006.01) |

(52) U.S. Cl.

CPC ..... *A63C 17/0013* (2013.01); *A45B 3/00* (2013.01); *A63C 17/26* (2013.01); *B63H 16/04* (2013.01); *A63C 17/01* (2013.01)

(58) Field of Classification Search

CPC . A63C 17/0006; A63C 17/0013; A63C 17/01; A63C 17/011; A63C 17/26; A45B 5/00; A45B 9/04; A45B 3/00; A61H 3/0288; B63H 16/04

USPC ..... 280/819, 826

See application file for complete search history.

(56) References Cited

U.S. PATENT DOCUMENTS

| | | | | |
|---|---|---|---|---|
| 1,429,429 | A | 9/1922 | Hipwood | |
| 2,230,406 | A | 2/1941 | Johnson | |
| 3,040,757 | A | 6/1962 | Smith | |
| D262,646 | S * | 1/1982 | Mace | D21/775 |
| 5,088,513 | A | 2/1992 | Ostermeyer | |
| 5,236,222 | A | 8/1993 | Fletcher | |
| 5,490,825 | A * | 2/1996 | Wilkinson | A45B 3/00 482/109 |
| 5,713,382 | A * | 2/1998 | Midcap | A45B 9/04 135/44 |
| 6,910,246 | B2 | 6/2005 | Desmarais | |
| 8,465,056 | B2 | 6/2013 | Weir et al. | |
| 8,636,305 | B2 | 1/2014 | Gonzalez et al. | |
| 8,636,306 | B2 | 1/2014 | McBride | |
| 8,746,266 | B2 | 6/2014 | Palmer et al. | |
| 8,820,339 | B2 | 9/2014 | Goodwin | |
| 9,259,063 | B2 * | 2/2016 | Moulton, III | A61H 3/0288 |

(Continued)

OTHER PUBLICATIONS

Sk8pole, available at http://sk8pole.com.

*Primary Examiner* — John Walters

(74) *Attorney, Agent, or Firm* — McCarter & English, LLP

(57) ABSTRACT

Exemplary embodiments are directed to pusher tips including a body with a top section and a base section. The top section can be configured for attachment to a paddle shaft and the base section can be configured for placement against a surface. The base section can define a substantially convex, continuous and planar surface. Exemplary embodiments are also directed to pusher tip systems and paddle shafts.

19 Claims, 11 Drawing Sheets

(56) References Cited

U.S. PATENT DOCUMENTS

| | | | | |
|---|---|---|---|---|
| 2004/0025926 | A1 | 2/2004 | Gin et al. | |
| 2011/0175338 | A1* | 7/2011 | Senseman | A63C 17/0013 280/821 |
| 2012/0049502 | A1* | 3/2012 | Ascunce | A63C 17/0013 280/821 |
| 2014/0332045 | A1* | 11/2014 | Rudin | A45B 7/005 135/82 |
| 2016/0228759 | A1 | 8/2016 | Henrie et al. | |

* cited by examiner

PUSHER TIP AND ASSOCIATED SYSTEMS

CROSS-REFERENCE TO RELATED APPLICATIONS

The present application claims the benefit of a co-pending U.S. Provisional Patent Application No. 62/186,664, which was filed on Jun. 30, 2015. The entire content of the foregoing provisional application is incorporated herein by reference.

TECHNICAL FIELD

The present disclosure relates to pusher tips and associated systems and, in particular, to pusher tips which provide improved flexibility and control, and support a reactive bending moment on a tubular paddle shaft or on a tapered paddle shaft pole.

BACKGROUND

While standing on a skateboard, a person can propel themselves and/or modify course of direction with a paddle, comprising a shaft, handle and pusher tip. Pusher tips are generally mounted to a distal end of an axially symmetrical paddle shaft such that the pusher tip can be positioned in contact with the ground during use. In particular, a user can push off or grip the ground with the pusher tip by extending the paddle shaft while remaining on a skateboard or roller skates.

Some pusher tips can define a substantially spherical shape with a planar surface and include an opening into which the distal end of the paddle shaft is secured. Such pusher tips can conform to the surface of the ground and mostly roll with the paddle shaft movement. However, such pusher tips generally cannot support bending moment on the distal end of the paddle shaft, resulting in a bouncy feeling at the distal end of the paddle shaft, and fail to provide flexibility near the connection to the paddle shaft due to the insertion of the distal end of the paddle shaft into the pusher tip body.

Some pusher tips can include a base section, a top section and a flexible central section connecting the base and top sections. The base section can grip the ground without rolling and the angle of the top section can vary by flexing the flexible central section with the paddle shaft. However, such pusher tips generally cannot support bending moment on the paddle shaft distal end, and collapse, buckle or let go of the ground part way through a stroke.

Paddle shafts generally define solid or tubular, elongated forms with a uniform outer diameter along the length of the paddle shaft. The uniform outer diameter of the paddle shaft can result in uniform flexural rigidity and therefore a uniform deflection which, in turn, results in most of the bending nearest the lower hand (fulcrum) and uniformly diminishing bending toward the distal end. Such a configuration yields less flexibility and responsiveness, and therefore limits the potential energy invested into each stroke. Excessive user strength is needed to bend a uniform diameter solid or tubular shaft for the purpose of loading substantial potential energy, and excessive user strength is further needed to control the potential energy release in a way to propel themselves forward.

Some paddle shafts can include tubular telescoping sections to provide adjustment in overall length. However, telescoping paddle shafts generally cannot support the high bending required to significantly flex the shaft because, each of the telescoping joints creates a step change in flexural rigidity which results in localized bending deflections exceeding the flexural properties of the material of fabrication. As such, the telescoping paddle shaft can structurally fail when attempting to load potential energy through flexure.

Pusher tips can wear out with use. Although pusher tips are generally fabricated from an elastomeric material to grip the ground surface during use, this attribute causes the pusher tip to abrade and wear over time. The connection of the pusher tip and the distal end of the paddle shaft can be facilitated with a male threaded rod at the distal end of the paddle shaft and a female threaded pusher tip insert. For a right-hand threaded rod, pushing off from one side tightens the connection between the threaded rod and the insert, while pushing off from the other side loosens the connection, resulting in the potential for the pusher tip to disconnect from the distal end of the paddle shaft.

Taping the threads to improve the tightening interference between the threaded rod and female threads of the insert, or any other means of thread locking, can result in a connection that is too tight for disconnecting in the future. Some pusher tip systems can include a pusher tip insert acting as the connecting element between the distal end of the paddle shaft and a threaded rod of the pusher tip. However, if the force to loosen the threaded rod of the pusher tip is higher than the breaking force of the adhesive bond between the insert and the distal end of the paddle shaft, the act of unscrewing the pusher tip from the insert can loosen the insert relative to the paddle shaft.

Thus, a need exists for pusher tips that can accommodate improved flexibility and control, and support reactive bending moment on a paddle shaft. A further need exists for paddle shafts that can accommodate easy and comfortable flexure for storing and returning potential energy for a stroke. A further need exists for pusher tip inserts that maintain their position within the distal end of the paddle shaft during use and further maintain a tight interference with a threaded rod of a pusher tip to resist separation between the pusher tip and the paddle shaft during use. These and other needs are addressed by the pusher tips and associated systems of the present disclosure.

SUMMARY

The present disclosure is directed to an exemplary pusher tip. One object of the invention is that the pusher tip includes a body including a top section and a base section. The top section can be configured for attachment to a paddle shaft and the base section can be configured for placement against a surface. Another object of the invention is that the base section defines a convex, continuous and planar surface.

The present disclosure is also directed to an exemplary pusher tip system. One object of the invention is that the pusher tip system includes a paddle shaft including a proximal end and a distal end. Another object of the invention is that the pusher tip system includes a pusher tip at the distal end of the paddle shaft having a distal tapered pole shape. Another object of the invention is that the pusher tip is secured to the distal end of the paddle shaft. Another object of the invention is that the pusher tip and the paddle shaft are fabricated as a single-piece construction. The pusher tip can include a body including a top section and a base section. The base section can be configured for placement against a surface. Another object of the invention is that the base section of the pusher tip defines a convex, continuous and planar surface.

The present disclosure is further directed to an exemplary paddle shaft. One object of the invention is that the paddle shaft includes an elongated body including a proximal end and a distal end. The proximal end defines a proximal end width and the distal end defines a distal end width. Another object of the invention is that the elongated body defines a tapered configuration such that the proximal end width is dimensioned greater than the distal end width. Another object of the invention is that the paddle shaft defines a tapered pole shape along the entire length or a majority of the length of the paddle shaft. The tapered configuration of the paddle shaft provides for advantageous bending moment and conforming attributes during use of the system.

The present disclosure is further directed to an exemplary pusher tip insert. One object of the invention is that the pusher tip insert includes flat profiles which, when adhered or fixed inside the distal end of the paddle shaft, resist the reactive forces when unscrewing the pusher tip from the pusher tip insert.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed pusher tips and associated systems, reference is made to the accompanying figures, wherein.

DESCRIPTION OF EXEMPLARY EMBODIMENTS

Figure 1:
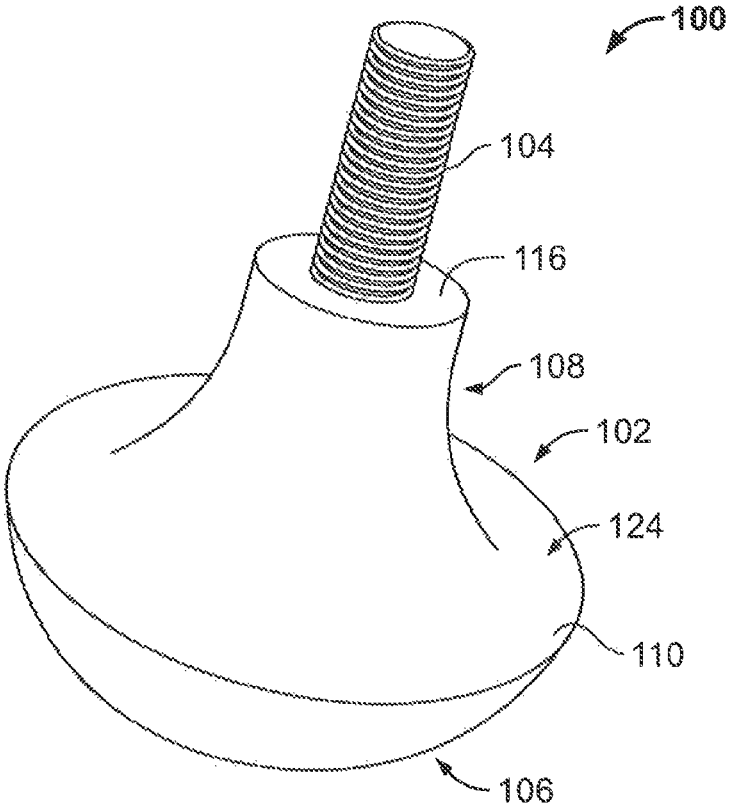
FIG. 1 is a perspective view of a first embodiment of an exemplary pusher tip according to the present disclosure.

In accordance with embodiments of the present disclosure, exemplary pusher tips and paddle shafts are provided to allow for greater control and flexibility during use in skateboard or longboard applications. The exemplary pusher tips and paddle shafts flex to conform or adjust to the position of the user, providing a smooth and responsive stroke during use. The flexibility of the pusher tips further allows for greater feel of the ground and control for purposes of acceleration or deceleration.

The exemplary pusher tips can include a body including a top section and a base section. The top section can be configured for attachment to a paddle shaft. The base section can be configured for placement against a surface (e.g., the ground). The base section can define a substantially convex, continuous and planar surface. In some embodiments, the body can define a C-shaped or hook-shaped configuration with a hollow interior. In some embodiments, the body can be variably flexible between a proximal end and a distal end of the body.

The top section and the base section can be joined at a continuous connecting edge defining an outer perimeter of the pusher tip. The top section can define a top half of the pusher tip and the base section can define a bottom half of the pusher tip. The top section can define a substantially concave surface. The concave surface of the top section can include a transition from a large diameter at or near the connecting edge to a small diameter at or near a top surface of the top section.

At least a portion of the top section can be configured to flex relative to the base section. In some embodiments, a joint between the top section and the connecting edge can form a hook section. Upon application of force against the surface, the base section can be configured to flex to increase a contact surface area of the base section with the surface. In particular, rather than a single point of contact, a portion of the convex surface of the base section can flatten or conform to a portion of the surface. Thus, flexure of the base section to increase the contact surface area includes conforming the contact surface area to the portion of the surface against which the base section is pressed.

The pusher tips can include a fixation element (e.g., a male fixation element) extending from the top surface of the top section. The fixation element can include one of a threaded rod or a threaded bore. The fixation element can further include an anchoring section secured within the top section to prevent disengagement of the fixation element from the top section. The fixation element can extend substantially perpendicularly to the top surface of the top section.

In accordance with embodiments of the present disclosure, exemplary pusher tip systems are provided that include a paddle shaft and a pusher tip. The paddle shaft includes a proximal end and a distal end. The pusher tip can be detachably secured to the distal end of the paddle shaft. The pusher tip can include a body including a top section and a base section. The top section can be configured for attachment to the paddle shaft. The base section can be configured for placement against a surface. The base section can define a convex, continuous and planar surface. The paddle shaft can include an elongated body defining a tapered configuration tapering from a proximal end width to a narrower distal end width.

In accordance with embodiments of the present disclosure, exemplary paddle shafts are provided that include an elongated body. The elongated body includes a proximal end and a distal end. The proximal end can define a proximal end width and the distal end can define a distal end width. The elongated body can define a substantially tapered configuration such that the proximal end width is dimensioned greater than the distal end width.

The elongated body can include a handle secured to the proximal end. The elongated body can include a fixation element at the distal end configured for attachment of a pusher tip thereto. The fixation element can include a threaded bore formed in the distal end or a threaded rod extending from the distal end configured and dimensioned to mate with the threads of the fixation element of the pusher tip. The elongated body can be formed from a single-piece construction to reduce strain or stress points along the length of the elongated body. The elongated body can include a tubular form with a hollow core.

Figure 2:
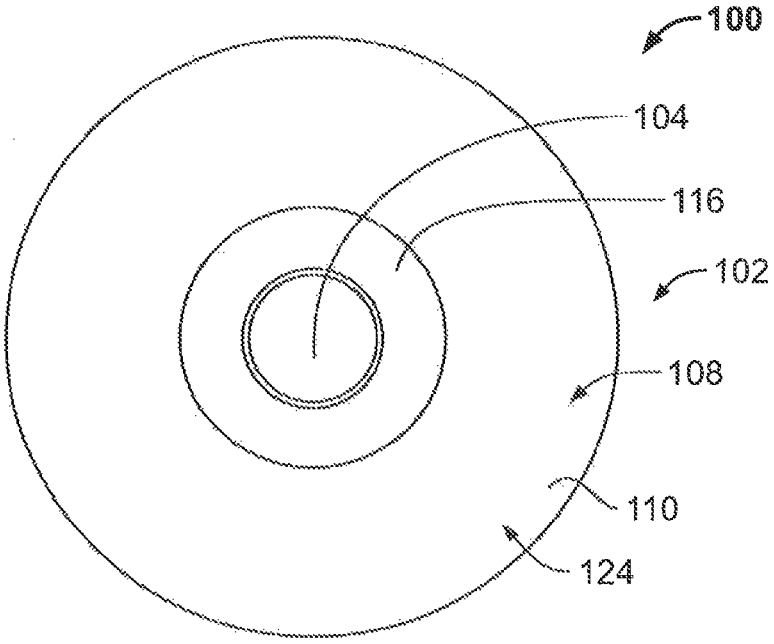
FIG. 2 is a top view of a first embodiment of an exemplary pusher tip according to the present disclosure.
Figure 3:
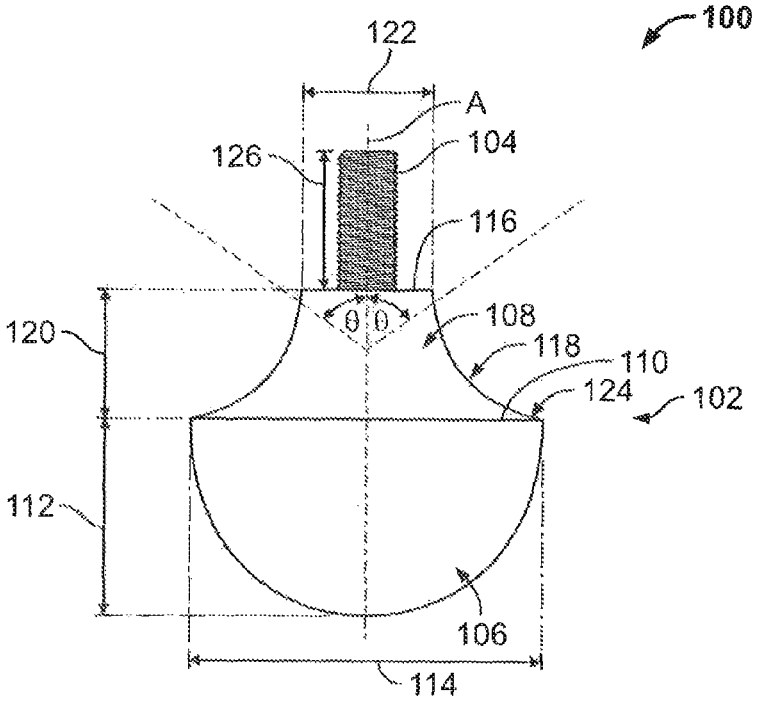
FIG. 3 is a side view of a first embodiment of an exemplary pusher tip according to the present disclosure.

FIGS. 1-3 are perspective, top and side views of an exemplary pusher tip 100 in accordance with embodiments of the present disclosure. The pusher tip 100 includes a pusher tip body 102 and a fixation element 104 (e.g., a threaded rod) secured to and extending from the pusher tip body 102. The pusher tip 100 can define a substantially symmetrical configuration. For example, the pusher tip 100 can be substantially symmetrical about a central, vertical axis A (see, e.g., FIG. 3). In some embodiments, the pusher tip body 102 can be formed from a flexible, elastomeric material, e.g., natural rubber, natural vulcanized rubber, nitrile rubber, milled polyurethane rubber, combinations thereof, or the like. Natural rubber can provide for maximum elongation or flexure, minimum hysteresis, and maximum static and sliding frictional grip. Nitrile rubber can be used as an alternative to natural rubber. In some embodiments, the pusher tip body 102 can be co-molded from two or more different materials.

In some embodiments, the pusher tip body 102 can define a hollow interior. In some embodiments, the pusher tip body 102 can define a solid interior. In some embodiments, some portions of the pusher tip body 102 can be hollow while other portions of the pusher tip body 102 can be solid. For example, in some embodiments, the pusher tip body 102 can include cut-outs (e.g., symmetrical, asymmetrical, or both) within the interior of the pusher tip body 102 for reduction of weight and/or to vary the flexibility properties of the body 102. As will be described in greater detail below, the elastomeric material allows portions of the pusher tip body 102 to flex upon application of force against the ground such that the pusher tip body 102 can conform to the surface of the ground. The flexure of the pusher tip body 102 further provides energy or a spring force for pushing off of the ground when accelerating on a longboard or skateboard.

The pusher tip body 102 includes a base section 106 (e.g., a first half) and a top section 108 (e.g., a second half). The base section 106 and the top section 108 can connect at a connecting edge 110. In some embodiments, the base section 106 and the top section 108 can be integrally formed from the same material. The base section 106 can define a substantially convex, hemispherical surface. In some embodiments, the base section 106 can define a planar or smooth surface. The base section 106 can be configured for placement against the ground and the elastomeric material can flex and grip the ground, thereby providing force for pushing off the ground or gripping the ground for reducing the speed of the user.

The planar or smooth surface area of the base section 106 maximizes the surface area configured for gripping the ground. Thus, rather than having only the surface area of protrusions or extensions for gripping the ground, the entire planar or smooth surface area of the base section 106 can be used to engage the ground during use. In some embodiments, at least a portion of the base section 106 can flex to increase the surface area of the point of contact between the base section 106 and the ground. The base section 106 can therefore act as a contact and wear surface relative to the ground.

The base section 106 can define a height 112 and a width or diameter 114. In some embodiments, the height 112 can be dimensioned between approximately 15 mm and approximately 50 mm. In some embodiments, the height 112 can be dimensioned as approximately 32.5 mm. In some embodiments, the width or diameter 114 can be dimensioned between approximately 50 mm and approximately 100 mm. In some embodiments, the width or diameter 114 can be dimensioned as approximately 75 mm.

The top section 108 of the pusher tip body 102 can define a substantially concave shoulder extending from the connecting edge 110 (e.g., from the top edge of the base section 106) to a top surface 116 of the pusher tip body 102. The concave top section 108 can define a radius 118. The concave form of the top section 108 (and/or the inherent elongated properties of the material of fabrication of the pusher tip 100) results in a variation in flexibility along the surface of the top section 108. In particular, the top section 108 can define a wider diameter at the connecting edge 110 (e.g., a distal end of the top section 108) and a smaller diameter at the top surface 116 (e.g., a proximal end of the top section 108), and a variation in diameter occurs along the height of the top section 108. Thus, the top section 108 can be least flexible at or near the connecting edge 110 and the flexibility or deflection can gradually increase along the concave curve leading to the top surface 116 and away from the connecting edge 110.

In particular, the flexibility of the top section 108 can be greater at or near the top section 108 as compared to the flexibility of the top section 108 at or near the connecting edge 108. The flexibility of the top section 108 provides a wide range of angles at which the pusher tip 100 can be used to press against and off the ground. In particular, the flexibility of the top section 108 allows the base section 106 to remain positioned against the ground while the user is in motion on the skateboard relative to the point at which the base section 106 contacts the ground.

The top section 108 can define a height 120, a bottom width and top width 122. In some embodiments, the height 120 can be dimensioned between approximately 15 mm and approximately 50 mm. In some embodiments, the height 120 can be dimensioned as approximately 28 mm. In some embodiments, the bottom width can be substantially similar in dimensioned to the width or diameter 114 of the base section 106. In some embodiments, the top width 122 can be dimensioned between approximately 15 mm and approximately 50 mm. In some embodiments, the top width 122 of the top section 108 can be dimensioned as approximately 26 mm. In some embodiments, the radius 118 of curvature of the top section 108 can be dimensioned between approximately 15 mm and approximately 50 mm. In some embodiments, the radius 118 of curvature of the top section 108 can be dimensioned as approximately 28 mm.

The joint between the connecting edge 110 and the top section 108 can form a hook section 124 around the circumference of the pusher tip 100. Due to the variable flexibility along the curve of the top section 108 and, in particular, the least flexible portion of the top section 108 being at or near the connecting edge 110, the hook section 124 can be formed in the least flexible portion of the top section 108. Thus, in some embodiments, the hook section 124 can be used to hook or grab onto objects to change the direction of motion of the user on the skateboard. For example, the hook section 124 can be used to hook or grab onto a pole such that the pusher tip 100 and paddle shaft allow the user to swing around the pole and change the direction of motion.

The fixation element 104 can be in the form of an externally threaded rod extending from the top surface 116 of the top section 108, e.g., a male fixation element. In some embodiments, the fixation element 104 can include a thread of, e.g., 1 inch×½ inch×13 UNC. In some embodiments, the height 126 of the fixation element 104 extending from the top surface 116 can be dimensioned between approximately 10 mm and approximately 50 mm. In some embodiments, the height 126 of the fixation element 104 extending from the top surface 116 can be dimensioned as approximately 28 mm. As will be discussed in greater detail below, the threaded rod of the fixation element 104 can be configured and dimensioned to mate with a complementary threaded bore at a distal end of a paddle shaft. The pusher tip 100 can thereby be detachably secured to the distal end of the paddle shaft.

As noted above, the flexible material of fabrication of the pusher tip 100 allows the top section 108 to flex relative to the base section 106. In particular, after the fixation element 104 has been secured to a distal end of a paddle shaft, the paddle shaft can be used to flex the top section 108 by angles 0 in each direction relative to the central, vertical axis A. Thus, in some embodiments, the base section 106 can remain substantially perpendicular to the ground (i.e., the vertical axis A is substantially perpendicular to the ground), and at least a portion of the top section 108 can flex in either direction of the vertical axis A by an angle θ. However, it should be understood that the angle of the fixation element 104 and the paddle shaft relative to the ground can be increased by rolling the base section 106 along the ground and further flexing the top section 108.

Figure 4:
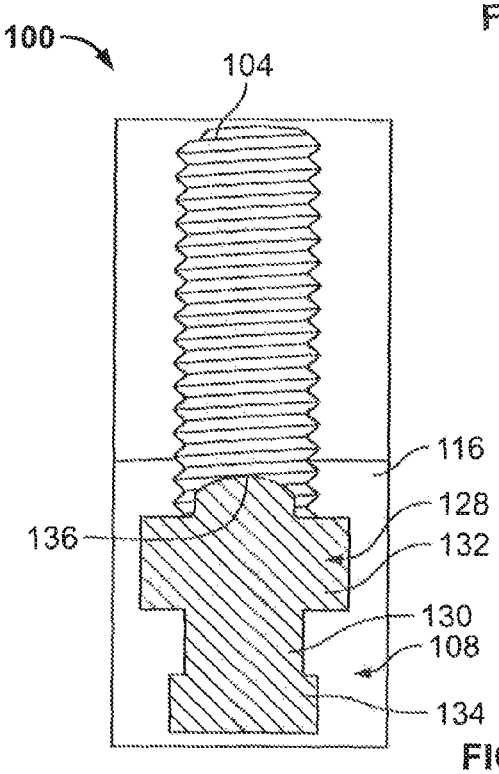
FIG. 4 is a partial cross-sectional view of a first embodiment of an exemplary pusher tip according to the present disclosure.
Figure 5:
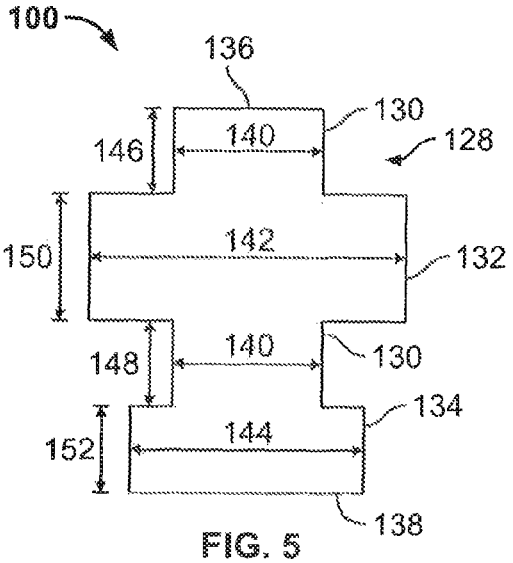
FIG. 5 is a diagrammatic, partial cross-sectional view of a first embodiment of an exemplary pusher tip according to the present disclosure.

With respect to FIGS. 4 and 5, partial cross-sectional views of the pusher tip 100 are provided. In particular, FIGS. 4 and 5 show an anchoring section 128 of the fixation element 104 molded into and secured within the top section 108. The anchoring section 128 can secure the fixation element 104 relative to the top section 108 such that the anchoring section 128 cannot rotate relative to the top section 108. In some embodiments, the anchoring section 128 can define a substantially elongated and planar form extending from the top surface 116 and into the top section 108. In some embodiments, the anchoring section 128 can define an elongated body 130 with one or more transverse protrusions 132, 134 extending therefrom. The protrusions 132, 134 can provide additional surface areas for gripping the anchoring section 128 within the top section 108 to prevent rotation of the anchoring section 128. In particular, the protrusions 132, 134 ensure a secure fixation of the anchoring section 128 within the top section 108.

For clarity, FIG. 5 provides a diagrammatic view of the anchoring section 128. Although illustrated with two transverse protrusions 132, 134, in some embodiments, the anchoring section 128 can include, e.g., one, two, three, four, or the like, transverse protrusions. As shown in FIG. 5, each pair of protrusions 132, 134 can be separated by a portion of the elongated body 130. In some embodiments, the protrusions 132, 134 can extend at different angles relative to the elongated body 130. In some embodiments, the elongated body 130 and/or the protrusions 132, 134 can define circular or rectangular cross-sections.

In one embodiments, a proximal end 136 of the anchoring section 128 can be fixed relative to the threaded rod portion of the fixation element 104, while a distal end 138 of the anchoring section 128 can be embedded within the top section 108. In some embodiments, the width 140 of the elongated body 130 can be dimensioned between approximately 5 mm and approximately 15 mm. In some embodiments, the width 140 of the elongated body 130 can be dimensioned as approximately 10 mm. In some embodiments, the portion of the elongated body 130 near the proximal end 136 and the portion of the elongated body 130 between the protrusions 132, 134 can be dimensioned with different widths 140. In some embodiments, a width 142 of the first protrusion 132 can be dimensioned between approximately 10 mm and approximately 30 mm. In some embodiments, a width 142 of the first protrusion 132 can be dimensioned as approximately 20 mm. In some embodiments, a width 144 of the second protrusion 134 can be dimensioned between approximately 5 mm and approximately 20 mm. In some embodiments, a width 144 of the second protrusion 134 can be dimensioned as approximately 15 mm. Although illustrated as having different dimensions, in some embodiments, the widths 142, 144 of the first and second protrusions 132, 134 can be dimensioned substantially similarly.

In some embodiments, a height 146 of the portion of the elongated body 130 extending between the proximal end 136 and the first protrusion 132 can be dimensioned between approximately 2 mm and approximately 10 mm. In some embodiments, a height 146 of the portion of the elongated body 130 extending between the proximal end 136 and the first protrusion 132 can be dimensioned as approximately 3 mm. In some embodiments, a height 148 of the portion of the elongated body 130 extending between the first and second protrusions 132, 134 can be dimensioned between approximately 2 mm and approximately 10 mm. In some embodiments, a height 148 of the portion of the elongated body 130 extending between the first and second protrusions 132, 134 can be dimensioned as approximately 5 mm. Although illustrated as having different dimensions, in some embodiments, the heights 146, 148 can be dimensioned substantially similarly.

In some embodiments, a height 150 of the first protrusion 132 can be dimensioned between approximately 2 mm and approximately 15 mm. In some embodiments, a height 150 of the first protrusion 132 can be dimensioned as approximately 7 mm. In some embodiments, a height 152 of the second protrusion 132 can be dimensioned between approximately 2 mm and approximately 10 mm. In some embodiments, a height 152 of the second protrusion 132 can be dimensioned as approximately 5mm. Although illustrated as having different dimensions, in some embodiments, the heights 150, 152 can be dimensioned substantially similarly.

Figure 6:
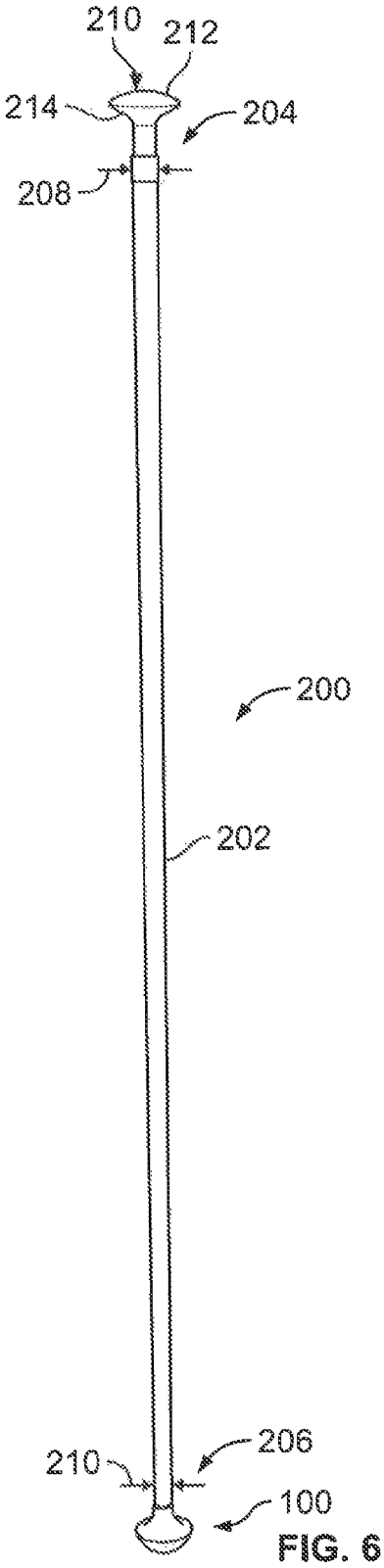
FIG. 6 is a side view of an exemplary paddle shaft assembled with a first embodiment of an exemplary pusher tip according to the present disclosure.
Figure 7:
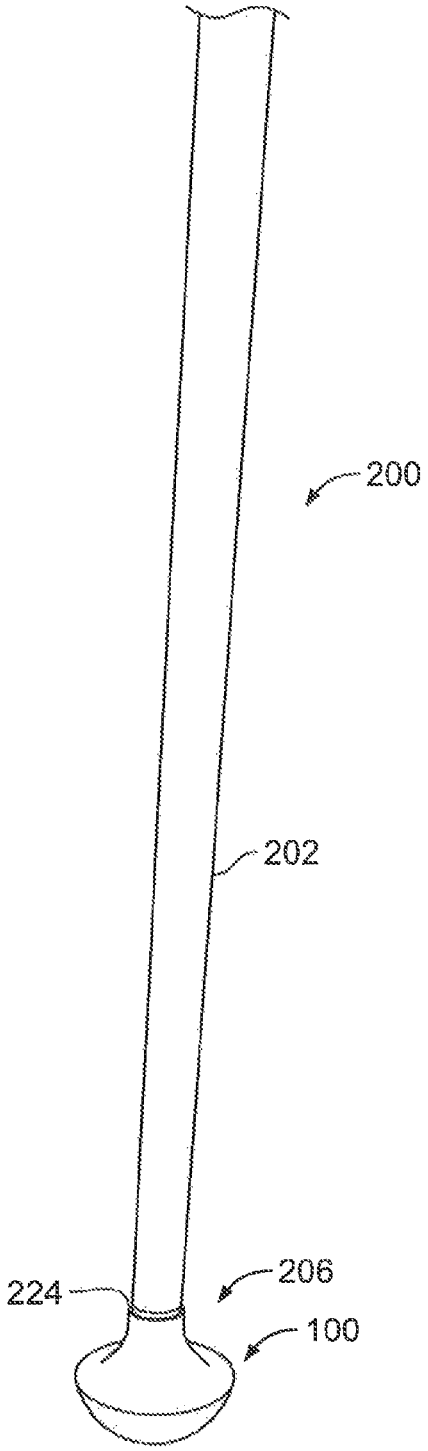
FIG. 7 is a detailed, side view of an exemplary paddle shaft assembled with a first embodiment of an exemplary pusher tip according to the present disclosure.

With reference to FIGS. 6 and 7, side views of an exemplary paddle shaft 200 assembled with the pusher tip 100 (e.g., a paddle shaft and/or a pusher tip system) are provided.

Although illustrated as an assembly of separate components, it should be understood that in some embodiments, the paddle shaft 200 and the pusher tip 100 can be fabricated as a single-piece construction. The paddle shaft 200 includes an elongated body 202 defining a proximal end 204 and a distal end 206. In some embodiments, the elongated body 202 can be formed from a material that is sufficiently rigid to support loads generated by pushing the paddle shaft 200 against the ground, while providing sufficient flexibility to flex under the weight and provide a "push-off" force from the ground to assist in acceleration. In some embodiments, the paddle shaft 200 can be fabricated from, e.g., natural bamboo (hollow), natural rattan (solid), extruded aluminum and fiber reinforced plastic composites (hollow), or the like. In some embodiments, the paddle shaft 200 can be fabricated from, e.g., fiberglass, carbon fibers, or the like.

In some embodiments, the elongated body 202 can be formed with a solid core the entire length of the elongated body 202. In some embodiments, the elongated body 202 can be formed from a tubular material such that the core is empty or hollow. Forming the paddle shaft 200 with a tubular elongated body 202 assists in reducing the overall weight of the paddle shaft 200. The entire length of the elongated body 202 can be formed from a single, continuous material, e.g., a single-piece construction, to prevent strain or stress points along the length of the elongated body 202. In particular, the elongated body 202 does not include concentric, telescoping joints which generally result in weak failure spots during flexure of paddle shafts due to local strains. The single, continuous material ensures that the paddle shaft 200 can withstand significant flexure during application of the paddle shaft 200 against the ground. In addition, the elongated body 202 does not include extensions, protrusions or other features extending therefrom between the proximal and distal ends 204, 206, thereby resulting in a distribution of forces along the length of the elongated body 202 that does not create specific areas of heightened strain during use. The paddle shaft 200 therefore provides sufficient structural support to withstand forces imparted on the paddle shaft 200, and the flexural properties of the paddle shaft 200 allow significant flexure during use for generation of push-off forces from the ground.

The elongated body 202 further defines a tapered body. In particular, the elongated body 202 gradually tapers from a first width 208 at or near the proximal end 204 to a second width 210 at or near the distal end 206. In some embodiments, half (or approximately half) of the length of the paddle shaft 200 extending from the proximal end 204 can define a substantially uniform diameter, and the remaining portion of the paddle shaft 200 extending towards the distal end 206 can define a tapered configuration. In some embodiments, one-third of the length of the paddle shaft 200 extending from the proximal end 204 can define a substantially uniform diameter, and the remaining portion of the paddle shaft 200 extending towards the distal end 206 can define a tapered configuration.

The first width 208 is dimensioned greater than the second width 210. In some embodiments, the first width 208 can be dimensioned between approximately 15 mm and approximately 50 mm. In some embodiments, the first width 208 can be dimensioned as approximately 30 mm. In some embodiments, the second width 210 can be dimensioned between approximately 10 mm and approximately 30 mm. In some embodiments, the second width 210 can be dimensioned as approximately 22 mm. In particular, the dimensions of the first and second widths 208, 210 can be selected such that a tapered configuration of the elongated body 202 is maintained.

The tapered configuration of the elongated body 202 provides a variation in flexibility along the length of the paddle shaft 200. In particular, an elongated body defining the same proximal and distal end widths results in a rigid paddle shaft that does not provide the desired flexibility during use. In contrast, the tapered configuration of the elongated body 202 provides for a greater flexibility of the paddle shaft 200 at or near the distal end 206 and a gradual decrease in flexibility in the direction of the proximal end 204. Specifically, the gradual increase in diameter of the elongated body 202 increases the rigidity of the elongated body 202 from the distal end 206 to the proximal end 204. The tubular upper section of the paddle shaft 200 flexes in a substantially linear manner from the lower hand of the user positioned below the proximal end 204 (e.g., a fulcrum effect), while the tapered pole section of the paddle shaft 200 flexes in a curved manner from the lower hand of the user (see, e.g., FIG. 13).

The paddle shaft 200 can include a handle or grip 210 secured to the proximal end 204. The grip 210 can be fabricated from a rubber or flexible material to provide comfort to the user when being grasped. The grip 210 includes a convex proximal edge 212 and angled edges 214 extending towards the proximal end 204 of the paddle shaft 200. The convex proximal edge 212 can be configured to fit within or against the palm of a user when the grip 210 is grasped during use.

Figure 8:
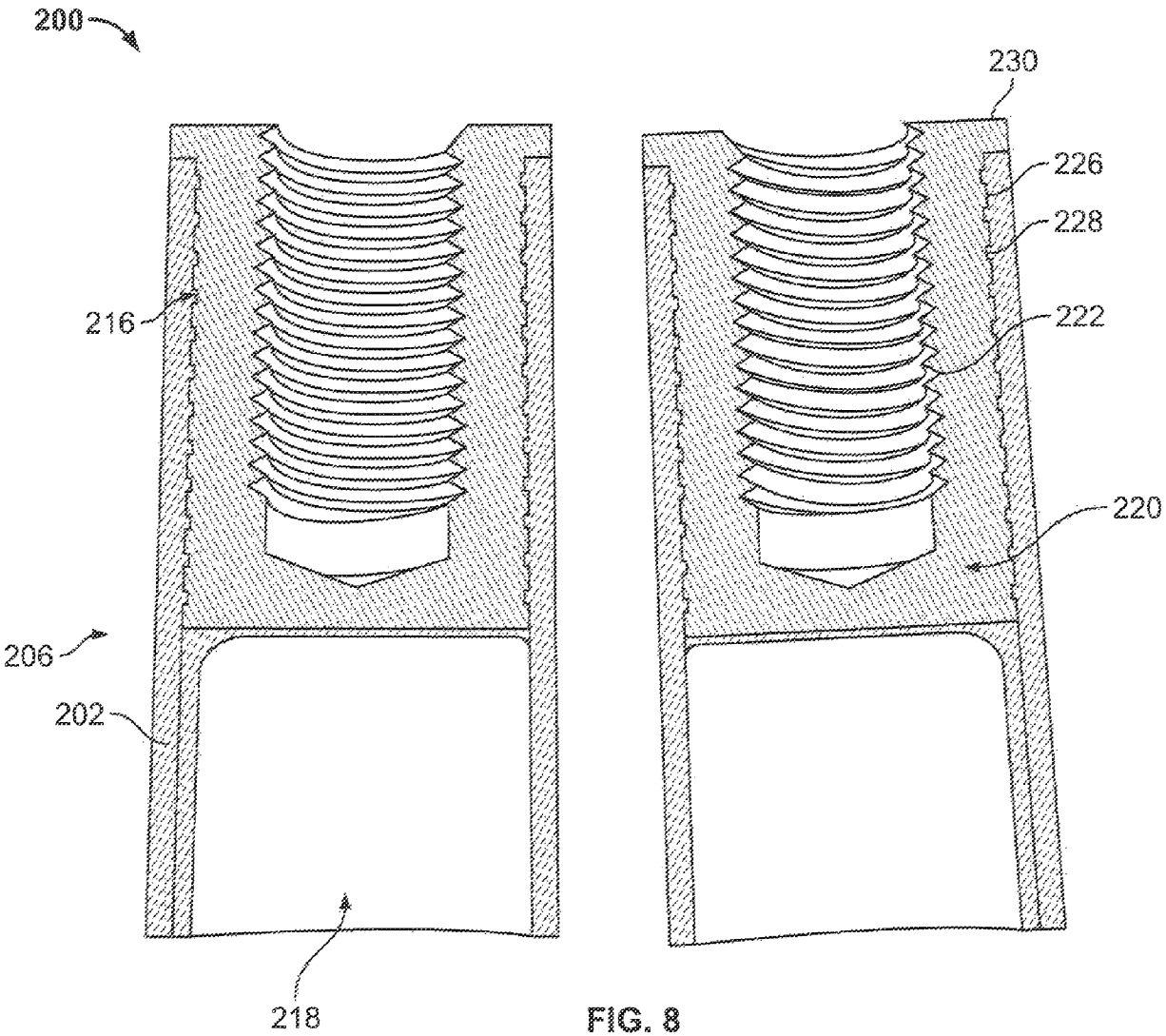
FIG. 8 is a partial, cross-sectional view of a distal end of an exemplary paddle shaft with a first embodiment of pusher tip insert according to the present disclosure.
Figure 9:
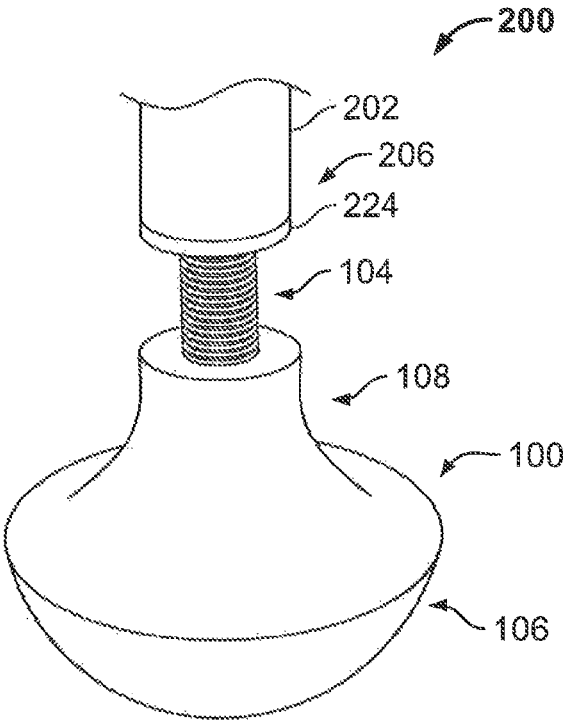
FIG. 9 is a detailed, side view of an exemplary paddle shaft partially assembled with a first embodiment of an exemplary pusher tip according to the present disclosure.

With reference to FIGS. 6-8, the distal end 206 of the paddle shaft 200 can include a pusher tip insert 216 (e.g., a female fixation element) formed therein. The pusher tip insert 216 can be formed complementary to the fixation element 104 of the pusher tip 100. The cross-sectional view of the distal end 206 of the paddle shaft 200 shown in FIG. 8 illustrates the hollow core 218 of the elongated body 202 and the solid core 220 of the pusher tip insert 216. In particular, the pusher tip insert 216 can include a substantially solid core 220 with a threaded bore 222 formed therein. The threaded bore 222 matches the outer threads on the fixation element 104 of the pusher tip 100 such that the pusher tip 100 can be secured to the distal end 206 of the paddle shaft 200 by screwing the fixation element 104 into the pusher tip insert 216.

In some embodiments, an outer surface 226 of the pusher tip insert 216 can define a substantially circular configuration and includes a plurality of circumferential grooves 228. During assembly, adhesive can be applied to the outer surface 226 of the pusher tip insert 216 prior to inserting the pusher tip insert 216 into the hollow distal end 206 of the paddle shaft 200. The circumferential grooves 228 provide additional surface area for the adhesive and ensure a stronger connection between the pusher tip insert 216 and the paddle shaft 200. The pusher tip insert 216 can include a round circumferential lip 230 configured to cover the distal end 206 of the paddle shaft 200 after assembly. The circumferential lip 230 can cover the opening in the distal end 206 of the paddle shaft 200 to prevent entrance of particles and/or moisture between the pusher tip insert 216 and the inner surface of the paddle shaft 200.

Figure 20:
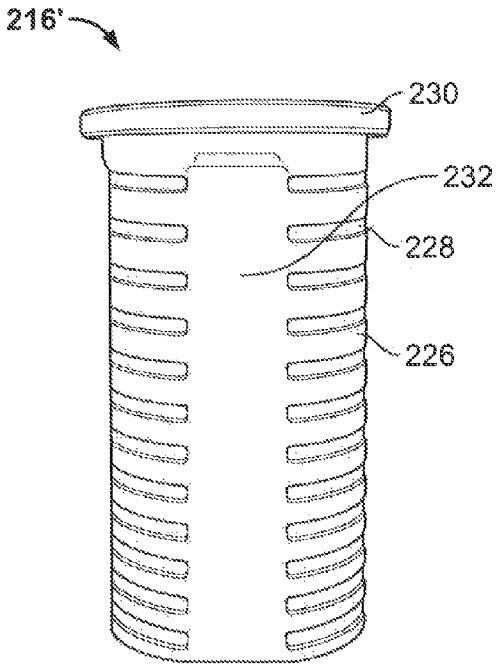
FIG. 20 is a side view of a second embodiment of an exemplary pusher tip insert according to the present disclosure.
Figure 21:
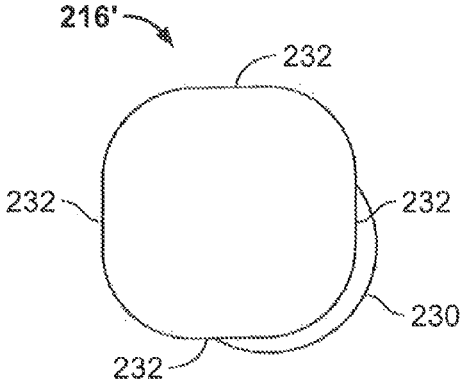
FIG. 21 is a bottom view of a second embodiment of an exemplary pusher tip insert according to the present disclosure.

In some embodiments, rather than defining a substantially circular configuration, the pusher tip insert can include flat profiles or sides to prevent separation and twisting of the pusher tip insert relative to the paddle shaft 200 when the fixation element 104 of the pusher tip 100 is disengaged from the pusher tip insert of the paddle shaft 200. In particular, FIGS. 20 and 21 show side and bottom views of a second embodiment of an exemplary pusher tip insert 216' (e.g., a female fixation element) that can be fixed relative to the distal end 206 of the paddle shaft 200. One or more portions of the outer surface 226 of the pusher tip insert 216' can be flattened to define a flat section 232 along the entire or a partial height of the pusher tip insert 216'.

In some embodiments, the pusher tip insert 216' can include a single flat section 232 on the outer surface 226. In some embodiments, the pusher tip insert 216' can include two flat sections 232 disposed on opposing sides of the outer surface 226. In some embodiments, the pusher tip insert 216' can include four flat sections 232 circumferentially disposed on the outer surface 226. After adhering the pusher tip insert 216' within the distal end 206 of the paddle shaft 200, the flat section(s) 232 prevent rotation of the pusher tip insert 216' within the paddle shaft 200 during disengagement of the fixation element 104 of the pusher tip 100 from the pusher tip insert 216'. In particular, if the force to loosen the fixation element 104 from the pusher tip insert 216' is higher than the breaking force of the adhesive bond between the pusher tip insert 216' and the paddle shaft 200, the flat section(s) 232 prevent the pusher tip insert 216' from moving relative to the paddle shaft 200, thereby preventing breaking of the adhesive bond between the pusher tip insert 216' and the paddle shaft 200. A stronger structure can therefore be achieved between the pusher tip insert 216' and the paddle shaft 200.

In some embodiments, a lock washer 224 can be positioned between the top surface 116 of the pusher tip 100 and the distal end 206 of the paddle shaft 200 to prevent undesired unthreading, rotation and disengagement of the fixation element 104 relative to the pusher tip insert 216. In some embodiments, means for increasing the friction between the threads on the fixation element 104 and the pusher tip insert 216 can be included. For example, in some embodiments, textured tape (e.g., hockey tape, or the like) can be wrapped around the threads of the fixation element 104 to improve the friction and grip between the complementary threads. As a further example, in some embodiments, thread lock (e.g., LOCTITE®, or the like) can be applied to at least a portion of the fixation element 104 to improve the friction and grip between the complementary threads. The ability to secure and detach the pusher tip 100 from the paddle shaft 200 advantageously allows a user to alternate the types of pusher tips 100 being used with the paddle shaft 200 and/or allows a user to replace a worn or damaged pusher tip 100 without necessitating changing of the entire paddle shaft 200.

Figure 15:
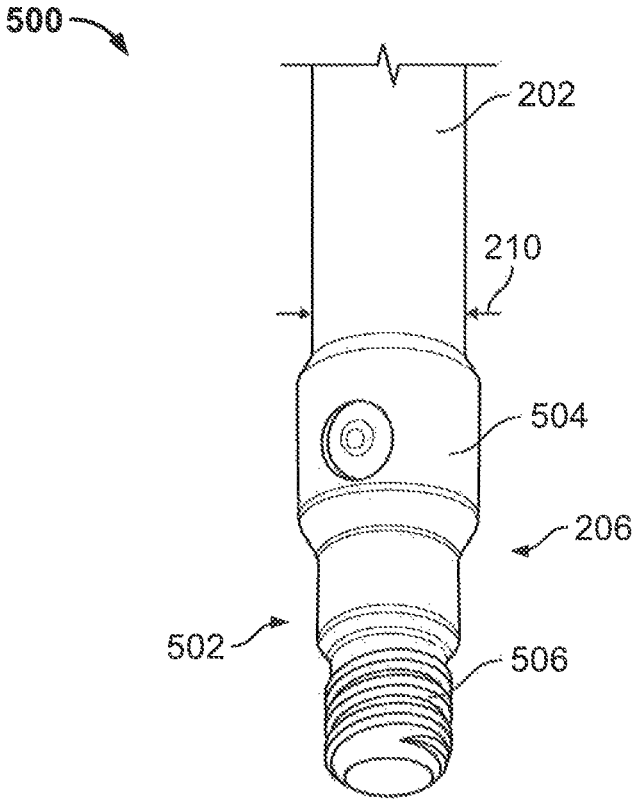
FIG. 15 is a side view of a distal end of an exemplary paddle shaft according to the present disclosure.
Figure 16:
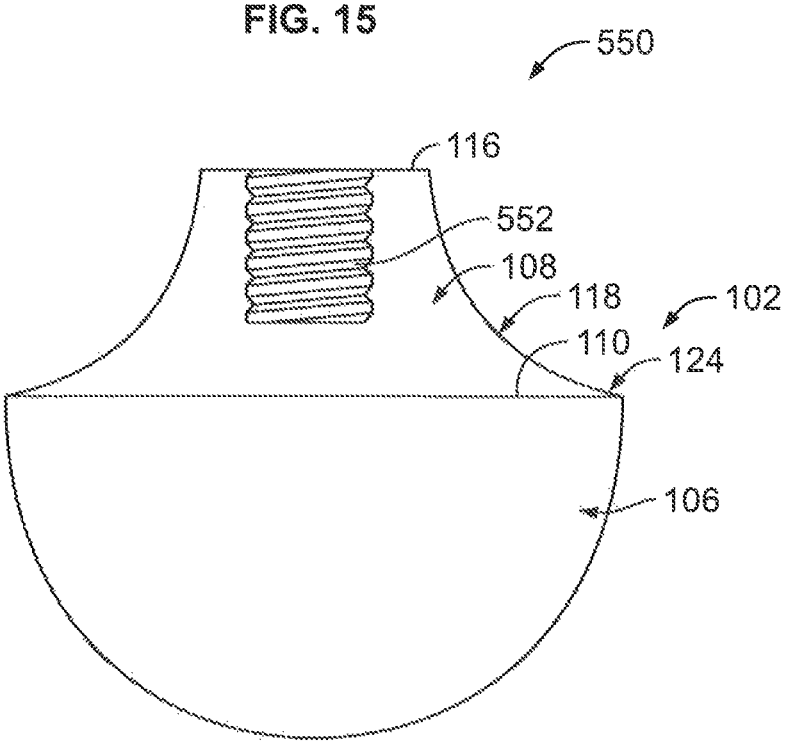
FIG. 16 is a partial cross-section, side view of an exemplary pusher tip according to the present disclosure.

In some embodiments, the fixation element 104 can be in the form a female fixation element (substantially similar to the threaded bore 222) and the pusher tip insert 216 can be in the form of a male fixation element, e.g., an inverted configuration. For example, FIGS. 15 and 16 show a detailed view of a paddle shaft 500 and a partially cross-sectional view of a pusher tip 550. The paddle shaft 500 and the pusher tip 550 can be substantially similar in structure and function to the paddle shaft 200 and the pusher tip 100, respectively, except for the distinctions noted herein. As such, like structures are labeled with like reference numbers.

In particular, rather than including a female pusher tip insert 216, the paddle shaft 200 can include a male pusher tip insert 502 (e.g., a male fixation element) extending from the distal end 206. In some embodiments, the pusher tip insert 502 can be integrally formed with the elongated body 202. In some embodiments, the pusher tip insert 502 can include a cap 504 including an inner bore configured and dimensioned to receive therein a portion of the distal end 206 of the paddle shaft 500. The pusher tip insert 502 includes outer threads 506 complementary to a female fixation element 552 formed in the body 102 (e.g., the top section 108) of the pusher tip 550. In particular, the fixation element 552 can be in the form of a bore including inner threads. The pusher tip insert 502 can therefore be threaded into the female fixation element 552 formed in the pusher tip 550, allowing a user to replace a worn or damaged pusher tip 550 without necessitating changing of the entire paddle shaft 500.

Figure 10:
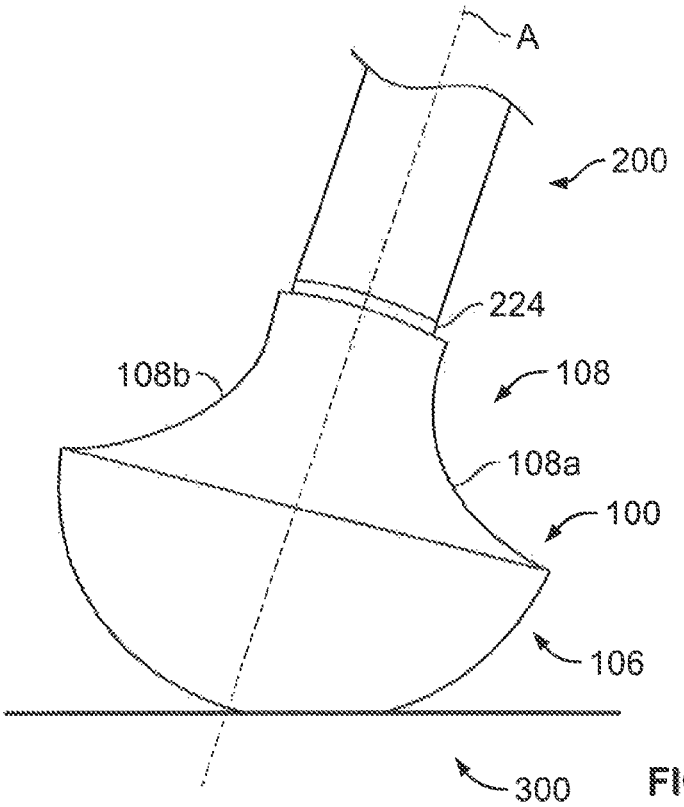
FIG. 10 is a detailed view of a first embodiment of an exemplary pusher tip positioned against the ground in an unflexed configuration according to the present disclosure.
Figure 11:
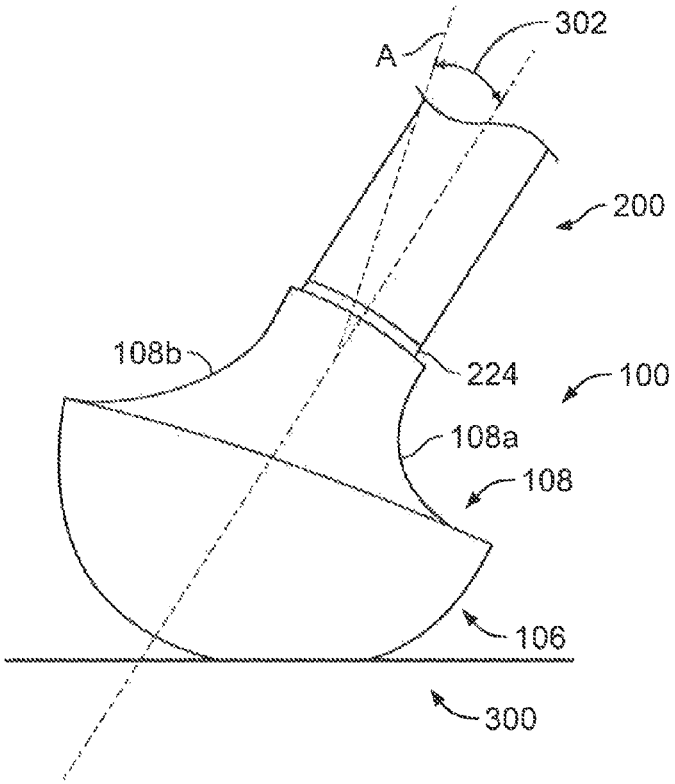
FIG. 11 is a detailed view of a first embodiment of an exemplary pusher tip positioned against the ground in a partially flexed configuration according to the present disclosure.
Figure 12:
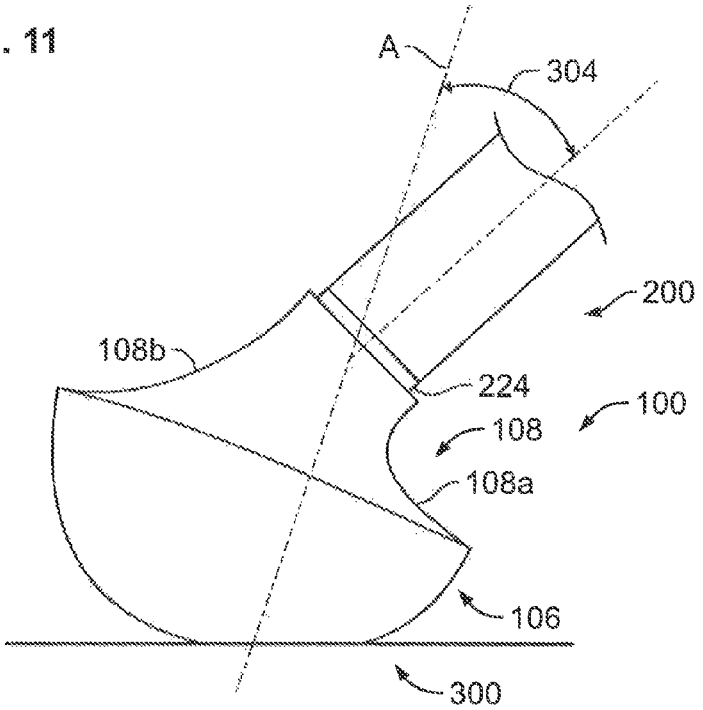
FIG. 12 is a detailed view of a first embodiment of an exemplary pusher tip positioned against the ground in a flexed configuration according to the present disclosure.

With reference to FIGS. 10-12, detailed side views of a paddle shaft 200 and pusher tip 100 assembly are provided positioned against the ground. In particular, FIGS. 10-12 show the pusher tip 100 in various stages of flexure. In all instances, the base section 106 of the pusher tip 100 is at least partially tilted or rolled relative to the ground 300. For purposes of flexure of the top section 108, reference will be made to the central, vertical axis A.

With respect to FIG. 10, the top section 108 is in a substantially unflexed configuration. In particular, the paddle shaft 200 extends in a substantially aligned manner relative to the central, vertical axis A. In addition, a first side 108*a* and a second side 108*b* of the top section 108 of the pusher tip 100 are not compressed or stretched. In some embodiments, a portion of the base section 106 can flex to increase the surface area of the base section 106 gripping the ground 300. In particular, the base section 106 can at least partially flex to conform to the surface of the ground 300, thereby increasing the surface area for gripping the ground 300 and/or increasing the amount of spring-back force generated when pushing off from the ground 300.

With respect to FIG. 11, the top section 108 is partially flexed by an angle 302 relative to the central, vertical axis A. In particular, the paddle shaft 200 imparts forces on the pusher tip 100 such that a first side 108*a* of the top section 108 is slightly compressed, while a second side 108*b* of the top section 108 is slightly stretched. The portion of the top section 108 near the connecting edge 110 can flex the least, while the flexure increases in the direction of the top surface 116. Due to the flexure of the top section 108, the pusher tip 100 can accommodate the position and orientation of the paddle shaft 200 during use.

With respect to FIG. 12, the top section 108 is flexed by an angle 304 relative to the central, vertical axis A of the pusher tip 100. In particular, the angle 304 is dimensioned substantially greater than the angle 302 of FIG. 11. Thus, the first side 108*a* of the top section 108 is compressed to a greater extent, and the second side 108*b* of the top section 108 is stretched to a greater extent, while the base section 106 continues to provide contact with the ground 300.

Figure 13:
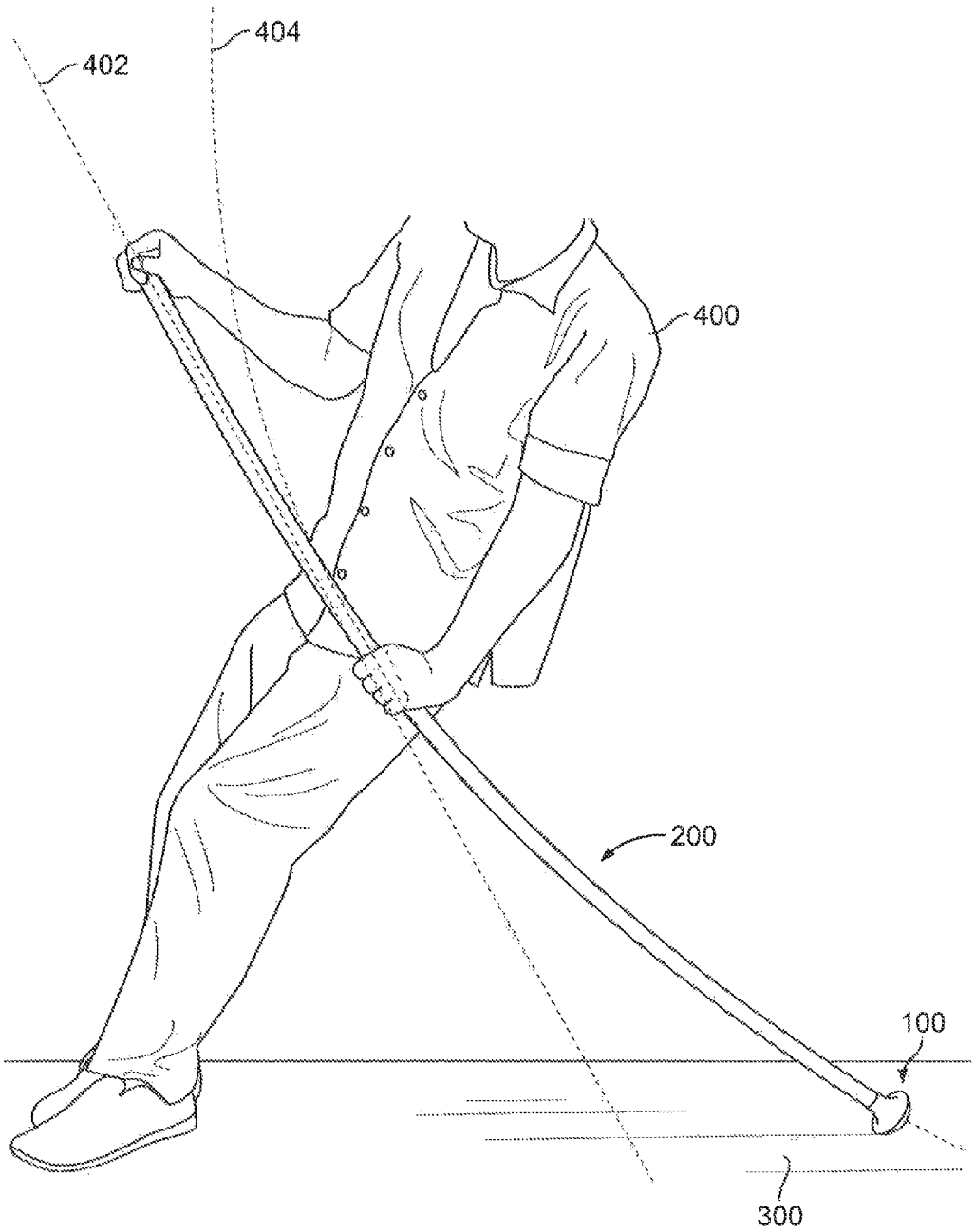
FIG. 13 is a side view of a paddle shaft and pusher tip assembly positioned against the ground in a flexed configuration according to the present disclosure.
Figure 14:
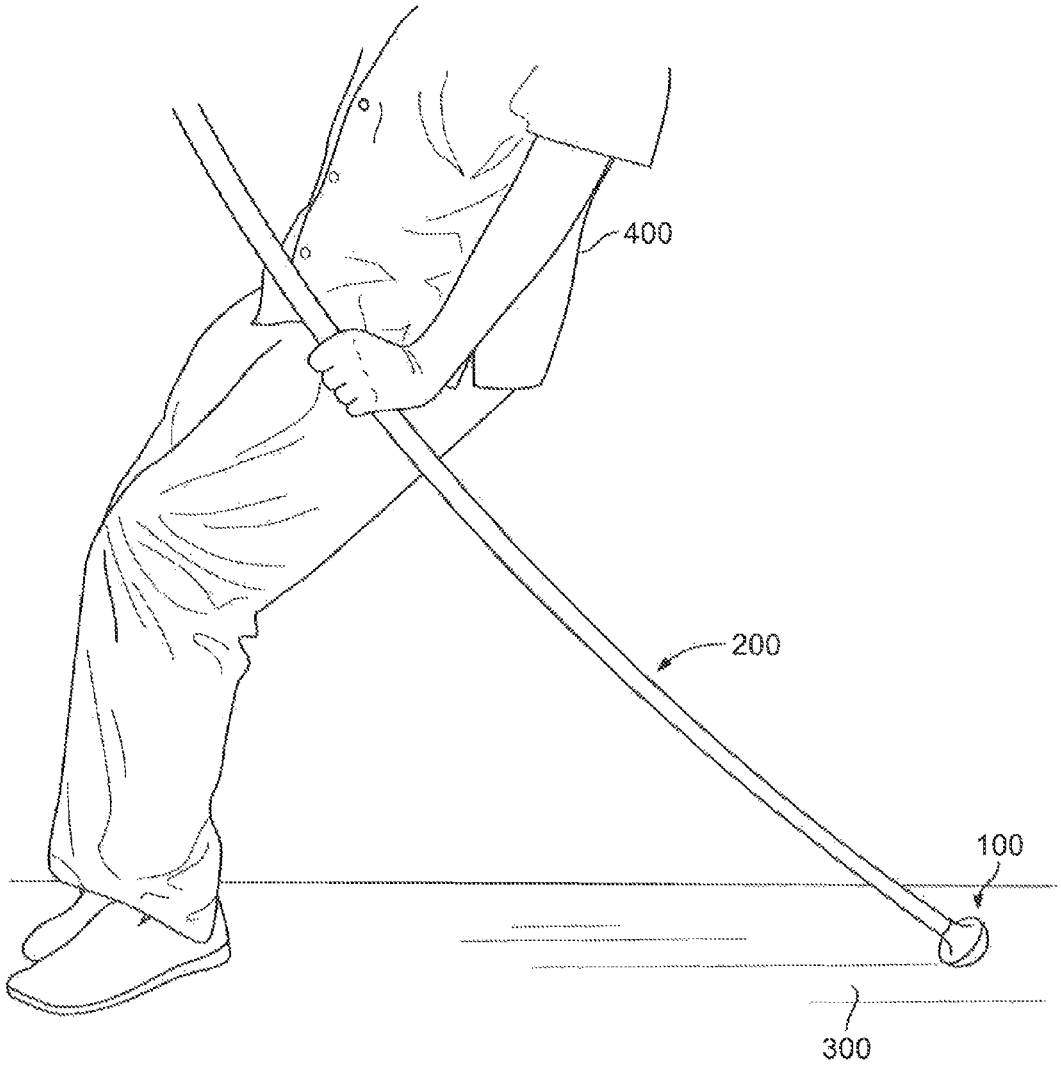
FIG. 14 is a side view of a paddle shaft and pusher tip assembly positioned against the ground in a flexed configuration according to the present disclosure.

With reference to FIGS. 13 and 14, side views of a paddle shaft 200 and pusher tip 100 assembly are provided in a flexed configuration. In particular, a user 400 is imparting a force on the paddle shaft 200 and the paddle shaft 200, in turn, imparts a force on the ground 300 with the pusher tip 100. As a force or load is imparted on the paddle shaft 200, the flexure of the paddle shaft 200 causes a flexure in the top section 108 of the pusher tip 100. To accommodate the flexure of the paddle shaft 200, the pusher tip 100 can also roll along the base section 106 while maintaining a grip on the ground 300. Thus, rather than being positioned flat against the ground 300 at a point aligned with the central, vertical axis A, the pusher tip 100 can be positioned against the ground 300 at any point of the base section 106. The pusher tip 100 therefore supports reactive bending moment forces on the paddle shaft 200 and prevents the paddle shaft 200 from buckling or collapsing under the imparted force.

The tapered configuration of the paddle shaft 200 provides for variation in flexure along the length of the paddle shaft 200. In particular, as shown in FIG. 13, one hand of the user is positioned against the grip of the paddle shaft 200 and the other hand is positioned at or near a midpoint of the paddle shaft 200. The hand positioned at or near the midpoint creates a fulcrum effect when the user imparts a force on the ground 300 with the pusher tip 100. Based on the fulcrum effect, the top portion of the paddle shaft 200 above the hand of the user flexes in a substantially linear manner, as represented by line 402. In contrast, due the fulcrum effect and the tapered configuration of the paddle shaft 200, the bottom portion of the paddle shaft 200 below the hand of the user flexes in a substantially curved manner, as represented by line 404. In particular, the tapered portion of the paddle shaft 200 provides for varying flexure of the paddle shaft along the length of the paddle shaft 200 as the structure of the paddle shaft 200 tapers in the direction of the distal end 206.

Figure 17:
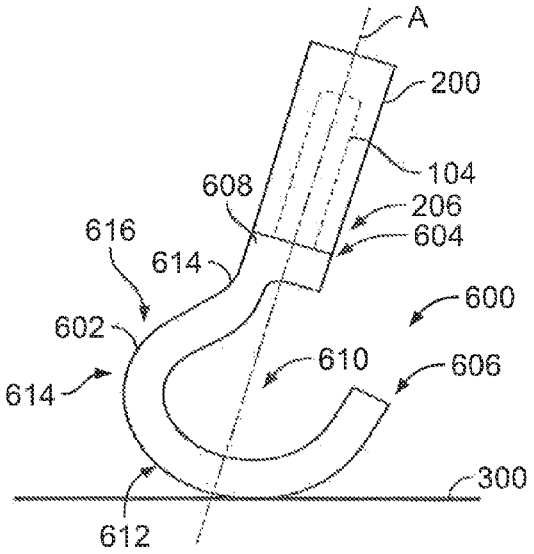
FIG. 17 is a detailed view of a second embodiment of an exemplary pusher tip defining a C-shaped configuration and positioned against the ground in an unflexed configuration according to the present disclosure.
Figure 18:
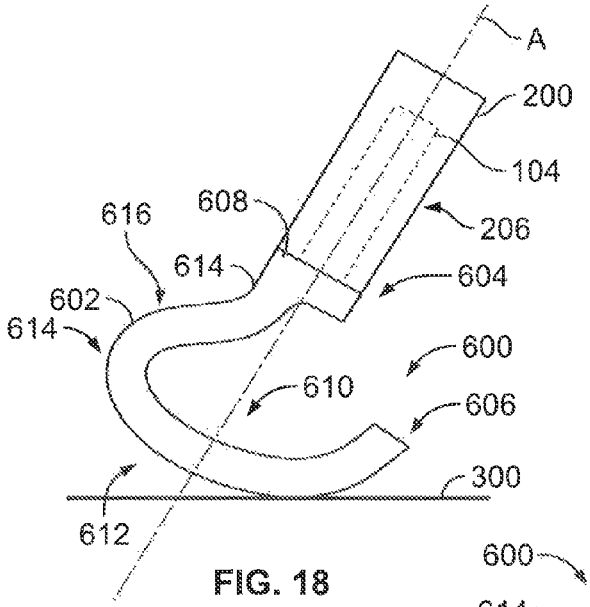
FIG. 18 is a detailed view of a second embodiment of an exemplary pusher tip defining a C-shaped configuration and positioned against the ground in a partially flexed configuration according to the present disclosure.
Figure 19:
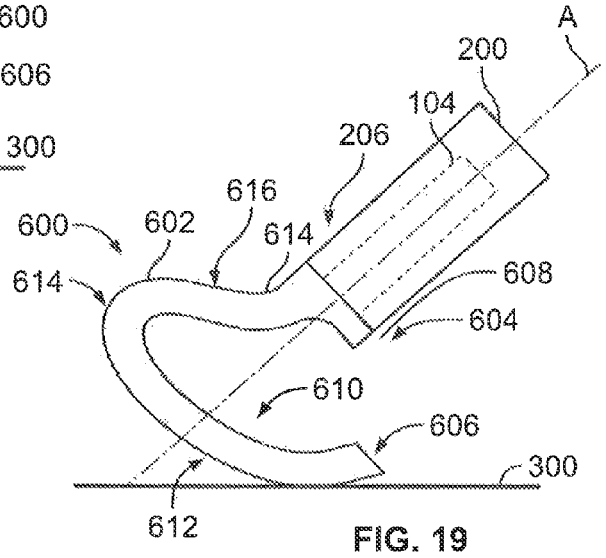
FIG. 19 is a detailed view of a second embodiment of an exemplary pusher tip defining a C-shaped configuration and positioned against the ground in a flexed configuration according to the present disclosure.

Turning to FIGS. 17-19, detailed views of a second embodiment of an exemplary pusher tip 600 are provided in an unflexed, partially flexed, and flexed configuration, respectively. The pusher tip 600 can be substantially similar in structure and/or function in certain aspects as the pusher tip 100. Therefore, like reference numbers are used to represent like structures. The pusher tip 600 can define a substantially C-shaped or hook-shaped pusher tip body 602. The pusher tip 600 can be asymmetrical along the central vertical axis A when viewed from the side shown in FIGS. 17-19, and can be substantially symmetrical when viewed from the front, rear, top or bottom. In some embodiments, the pusher tip body 602 can be formed from a flexible, elastomeric material, e.g., natural rubber, natural vulcanized rubber, nitrile rubber, milled polyurethane rubber, combinations thereof, or the like. Natural rubber can provide for maximum elongation or flexure, minimum hysteresis, and maximum static and sliding frictional grip. Nitrile rubber can be used as an alternative to natural rubber. In some embodiments, the pusher tip body 602 can be formed from a fiber reinforced polymeric composite.

The pusher tip 600 can include a proximal end 604 (e.g., a top section) and a distal end 606. The proximal end 604 can be in the form of a substantially flat top surface 608 configured for mating against the distal end 206 of the paddle shaft 200. The pusher tip 600 can include a fixation element 104 (e.g., a threaded rod) secured to and extending perpendicularly from the top surface 608. In some embodiments, one end of the fixation element 104 can be molded into the proximal end 604 of the pusher tip 600 (see, e.g., FIGS. 4 and 5). The fixation element 104 can be threaded into a complementary threaded opening (e.g., a female fixation element) formed in the distal end 206 of the paddle shaft 200. Although illustrated as an assembly of separate components, it should be understood that in some embodiments, the paddle shaft 200 and the pusher tip 600 can be fabricated as a single-piece construction.

The pusher tip body 602 can extend down and outward from one side of the top surface 608, and curves around to form a C-shaped or hook-shaped distal end 606. The pusher tip body 602 thereby defines a hollow interior or cavity 610. In some embodiments, the pusher tip body 602 can define a substantially half-cylinder configuration with the cavity 610 formed therein. Although shown from the side, it should be understood that when viewed from the front or rear, the pusher tip body 602 can define a width of, e.g., 0.5-3 inches, or the like. The cavity 610 allows portions of the pusher tip body 602 to flex upon application of force against the ground 300 such that the pusher tip body 602 can conform to the surface of the ground 300. The flexure of the pusher tip body 602 provides energy or a spring force for pushing off of the ground 300 when accelerating on a longboard or skateboard. Although illustrated as having segmented and interconnected portions forming the pusher tip body 602, in some embodiments, the pusher tip body 602 can define substantially continuous, curved surfaces.

The base section 612 of the pusher tip body 602 can define a substantially convex, hemispherical surface. The base section 610 can be configured for placement against the ground 300 and the elastomeric material can flex and grip the ground 300, thereby providing force for pushing off of the ground 300 or gripping the ground 300 for reducing the speed of the user. In some embodiments, the amount of flexibility of the material of fabrication can gradually vary between the proximal end 604 and the distal end 606. For example, in some embodiments, the proximal end 604 and the distal end 604 can be the least flexible, while a central section 614 of the pusher tip body 602 can be most flexible, with a gradual increase in flexibility leading from the proximal and distal ends 604, 606 to the central section 614. As a further example, in some embodiments, the proximal end 604 can be the flexible allowing for a strong connection with the distal end 206 of the paddle shaft 200, with a gradual increase in flexibility leading from the proximal end 604 to the distal end 606. The pusher tip body 602 can thereby flex at the central section 614, the distal end 606, or both, when the base section 610 is pushed against the ground 300.

In some embodiments, a connecting edge or joint 614 between the proximal end 606 and the remaining C-shaped or hook-shaped portion of the pusher tip body 602 can define a hook section 616 or edge. The hook section 616 can be used to hook or grab onto objects to change the direction of motion of the user on the skateboard. In some embodiments, the cavity 610 within the C-shaped or hook-shaped portion of the pusher tip body 602 can be used to hook or grab onto objects to change the direction of motion of the user on the skateboard. For example, the hook section 616, cavity 610, or both, can be used to hook or grab onto a pole such that the pusher tip 600 and paddle shaft 200 allow the user to swing around the pole and change the direction of motion. In some embodiments, the pusher tip body 602 can be flexible (variable or constant) from the joint 614 to the distal end 606. In some embodiments, the proximal end 604 of the pusher tip body 602 can define at least some flexibility.

With respect to FIG. 17, the pusher tip body 602 is in a substantially unflexed configuration. In particular, the paddle shaft 600 is positioned against the ground 300 without significant application of force against the ground 300 and the paddle shaft body 602 retains the C-shaped or hook-shaped configuration. In FIG. 18, a small amount of force has been imparted against the ground 300 and the pusher tip body 602 has flexed in areas between the joint 614 and the distal end 606. In particular, the pusher tip body 602 has flexed to bring the distal end 606 closer to the proximal end 604. In FIG. 20, a greater amount of force has been imparted against the ground 300 and the pusher tip body 602 has further flexed in areas between the joint 614 and the distal end 606 to the point that the distal end 606 is positioned even closer to the proximal end 604. Thus, as the pusher tip body 602 flexes, the proximal and distal ends 604, 606 can be brought closer to each other. In some embodiments, a portion of the base section 612 can flex to increase the surface area of the base section 612 in contact with or gripping the ground 300. In particular, the base section 612 can at least partially flex to conform to the surface of the ground 300, thereby increasing the surface area for gripping the ground 300 and/or increasing the amount of spring-back force generated when pushing off from the ground 300.

Figure 22:
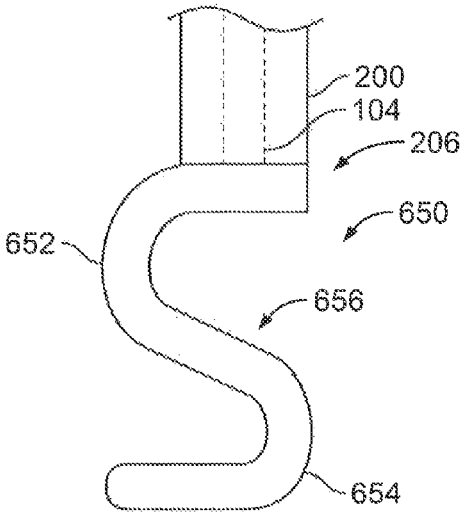
FIG. 22 is a detailed view of a third embodiment of an exemplary pusher tip defining an S-shaped configuration according to the present disclosure.
Figure 23:
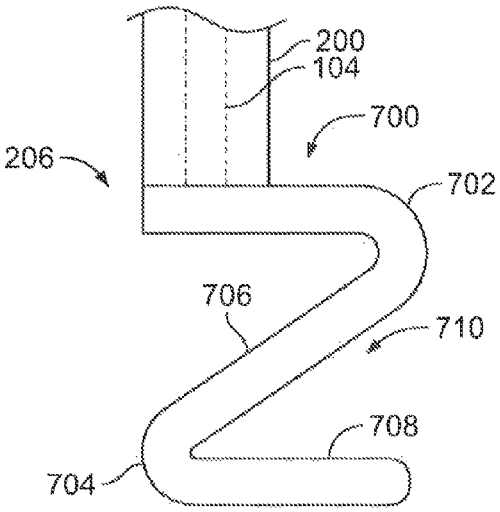
FIG. 23 is a detailed view of a fourth embodiment of an exemplary pusher tip defining a Z-shaped configuration according to the present disclosure.

In some embodiments, as shown in FIGS. 22 and 23, the pusher tip can define a substantially S-shaped or Z-shaped pusher tip body. In the S-shaped configuration, the pusher tip 650 can define substantially curved portions 652, 654 connected relative to each other while maintaining the curvature of the body 656. In the Z-shaped configuration, the pusher tip 700 can define substantially curved portions 702, 704 connected to substantially linear portions 706, 708 of the body 710. Thus, rather than having a continuously curved body 656, the Z-shaped configuration varies between curved portions 702, 704 and linear portions 706, 708.

The exemplary pusher tip and paddle shaft discussed herein flex to conform or adjust to the position of the user. Potential energy invested into flexing of the paddle shaft is returned toward the end of the stroke and provides smooth and responsive strokes during use. The flexibility of the pusher tip allows for greater feel of the ground and control for purposes of acceleration or deceleration.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A pusher tip, comprising:

a body including a top section and a base section, the top section defining a concave surface extending between a proximal end and a distal end, the top section configured for attachment to a paddle shaft at the proximal end, and the base section defining a convex, continuous and planer surface and configured for placement against a surface, wherein the concave surface of the top section provides a variation in flexibility of the top section with a low flexibility at or near the distal end and a gradual increase in flexibility along the concave surface leading away from the distal end towards the proximal end.

2. The pusher tip of claim 1, wherein the top section and the base section are joined at a connecting edge.

3. The pusher tip of claim 2, wherein a joint between the top section and the connecting edge forms a hook section.

4. The pusher tip of claim 1, wherein the concave surface of the top section comprises a transition from a large diameter at or near a connecting edge between the top section and the base section to a small diameter at or near a top surface of the top section.

5. The pusher tip of claim 1, wherein at least a portion of the top section is configured to flex relative to the base section.

6. The pusher tip of claim 1, wherein upon application of force against the surface, the base section is configured to flex to increase a contact surface area of the base section with the surface.

7. The pusher tip of claim 6, wherein flexure of the base section to increase the contact surface area includes conforming the contact surface area to a portion of the surface.

8. The pusher tip of claim 1, comprising a fixation element extending from a top surface of the top section, the fixation element including one of a threaded rod or a threaded bore.

9. The pusher tip of claim 8, wherein the fixation element comprises an anchoring section secured within the top section.

10. The pusher tip of claim 8, wherein the fixation element extends perpendicular to the top surface of the top section.

11. The pusher tip of claim 1, wherein the body defines a hook-shaped configuration with a hollow interior.

12. A pusher tip system, comprising:

a paddle shaft including a proximal end and a distal end, and a pusher tip at the distal end of the paddle shaft, the pusher tip including a body including a to section and a base section, the top section defining a concave surface extending between a proximal end and a distal end, the base section defining a convex, continuous and planar surface and configured for placement against a surface, wherein the concave surface of the top section provides a variation in flexibility of the top section with a low flexibility at or near the distal end and a gradual increase in flexibility along the concave surface leading away from the distal end towards the proximal end.

13. The pusher tip system of claim 12, wherein the paddle shaft comprises an elongated body defining a tapered configuration tapering from a proximal end width to a narrower distal end width.

14. The pusher tip system of claim 12, comprising a pusher tip insert disposed within the distal end of the paddle shaft, the pusher tip insert being configured to engage a fixation element extending from the pusher tip to secure the pusher tip to the distal end of the paddle shaft.

15. The pusher tip system of claim 14, wherein an outer surface of the pusher tip insert defines a circular configuration with at least one flat section formed on the outer surface.

16. A paddle shaft, comprising:

an elongated body including a proximal end and a distal end, the proximal end defining a proximal end width and the distal end defining a distal end width, wherein the elongated body defines a tapered configuration such that the proximal end width is dimensioned greater than the distal end width, the tapered configuration providing a variation in flexibility of the elongated body with a high flexibility at or near the distal end and a gradual decrease in flexibility along the tapered configuration leading away from the distal end towards the proximal end.

17. The paddle shaft of claim 16, wherein the elongated body comprises a fixation element at the distal end configured for attachment of a pusher tip thereto.

18. The paddle shaft of claim 17, wherein the fixation element comprises a one of a threaded bore formed in the distal end or a threaded rod extending from the distal end.

19. The paddle shaft of claim 16, wherein the elongated body comprises a single-piece construction.

* * * * *